US011345151B2

(12) United States Patent
Tamai et al.

(10) Patent No.: US 11,345,151 B2
(45) Date of Patent: May 31, 2022

(54) LIQUID DISCHARGE HEAD AND LIQUID DISCHARGE APPARATUS

(71) Applicant: SEIKO EPSON CORPORATION, Tokyo (JP)

(72) Inventors: Shotaro Tamai, Matsumoto (JP); Nobuhiro Naito, Hara-Mura (JP); Yuma Fukuzawa, Matsumoto (JP); Akinori Taniuchi, Matsumoto (JP); Shohei Mizuta, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/031,617

(22) Filed: Sep. 24, 2020

(65) Prior Publication Data

US 2021/0094296 A1 Apr. 1, 2021

(30) Foreign Application Priority Data

Sep. 27, 2019 (JP) ..... JP2019-176816

(51) Int. Cl.
*B41J 2/14* (2006.01)

(52) U.S. Cl.
CPC ..... *B41J 2/14233* (2013.01); *B41J 2/14201* (2013.01); *B41J 2002/14241* (2013.01); *B41J 2002/14306* (2013.01); *B41J 2202/08* (2013.01)

(58) Field of Classification Search
CPC ..... B41J 2/14233; B41J 2/14201; B41J 2002/14241; B41J 2002/14306; B41J 2202/08
See application file for complete search history.

(56) References Cited

U.S. PATENT DOCUMENTS

2014/0183284 A1* 7/2014 Nagatoya ..... B41J 2/1433 239/548

FOREIGN PATENT DOCUMENTS

JP 2004-216707 * 8/2004 .... B41J 2002/14241
JP 2014-124887 A 7/2014

* cited by examiner

*Primary Examiner* — Geoffrey S Mruk
(74) *Attorney, Agent, or Firm* — Workman Nydegger

(57) ABSTRACT

The communication plate has a first layer that defines a wall surface of the communication flow channel, a second layer stacked on a side of the first layer opposite to the wall surface, and a third layer stacked on a side of the second layer opposite to the first layer, and the thermal expansion coefficient of the second layer is smaller than the thermal expansion coefficient of the first layer and is smaller than the thermal expansion coefficient of the third layer.

15 Claims, 9 Drawing Sheets

LIQUID DISCHARGE HEAD AND LIQUID DISCHARGE APPARATUS

The present application is based on, and claims priority from JP Application Serial Number 2019-176816, filed Sep. 27, 2019, the disclosure of which is hereby incorporated by reference herein in its entirety.

BACKGROUND

1. Technical Field

The present disclosure relates to a liquid discharge head and a liquid discharge apparatus.

2. Related Art

Liquid discharge apparatuses such as printers are provided with liquid discharge heads for discharging liquid onto a recording medium or other media. For example, a liquid discharge head discussed in JP-A-2014-124887 includes a nozzle plate that has nozzles for discharging a liquid, a pressure chamber plate that has pressure chambers in communication with the nozzles and form a part of a flow channel, and a communication plate that is disposed between the nozzle plate and the pressure chamber plate and that has communication flow channels for guiding the liquid to the nozzles. The communication plate is a silicon single crystal substrate covered with a tantalum-oxide protective film.

The liquid discharge head described in JP-A-2014-124887, however, may produce stress due to the difference in the coefficient of thermal expansion between silicon and tantalum oxide, and the stress may be applied between the silicon substrate and the protective film, causing the protective film to peel off the silicon substrate. As a result, the liquid in the communication flow channels may flow into cracks in the protective film as a result of the peeling and may damage the silicon substrate.

SUMMARY

According to an aspect of the present disclosure, a liquid discharge head is provided. The liquid discharge head includes a nozzle plate having nozzles configured to discharge a liquid, a pressure chamber plate having pressure chambers in communication with the nozzles, the pressure chambers being configured to apply pressure to the liquid to discharge the liquid from the nozzles, and a communication plate disposed between the nozzle plate and the pressure chamber plate, the communication plate having a communication flow channel for guiding the liquid to the nozzles. The communication plate has a first layer that defines a wall surface of the communication flow channel, a second layer stacked on a side of the first layer opposite to the wall surface, and a third layer stacked on a side of the second layer opposite to the first layer, and the thermal expansion coefficient of the second layer is smaller than the thermal expansion coefficient of the first layer and is smaller than the thermal expansion coefficient of the third layer.

DESCRIPTION OF EXEMPLARY EMBODIMENTS

A. First Embodiment

A1. Apparatus Structure

Figure 1:
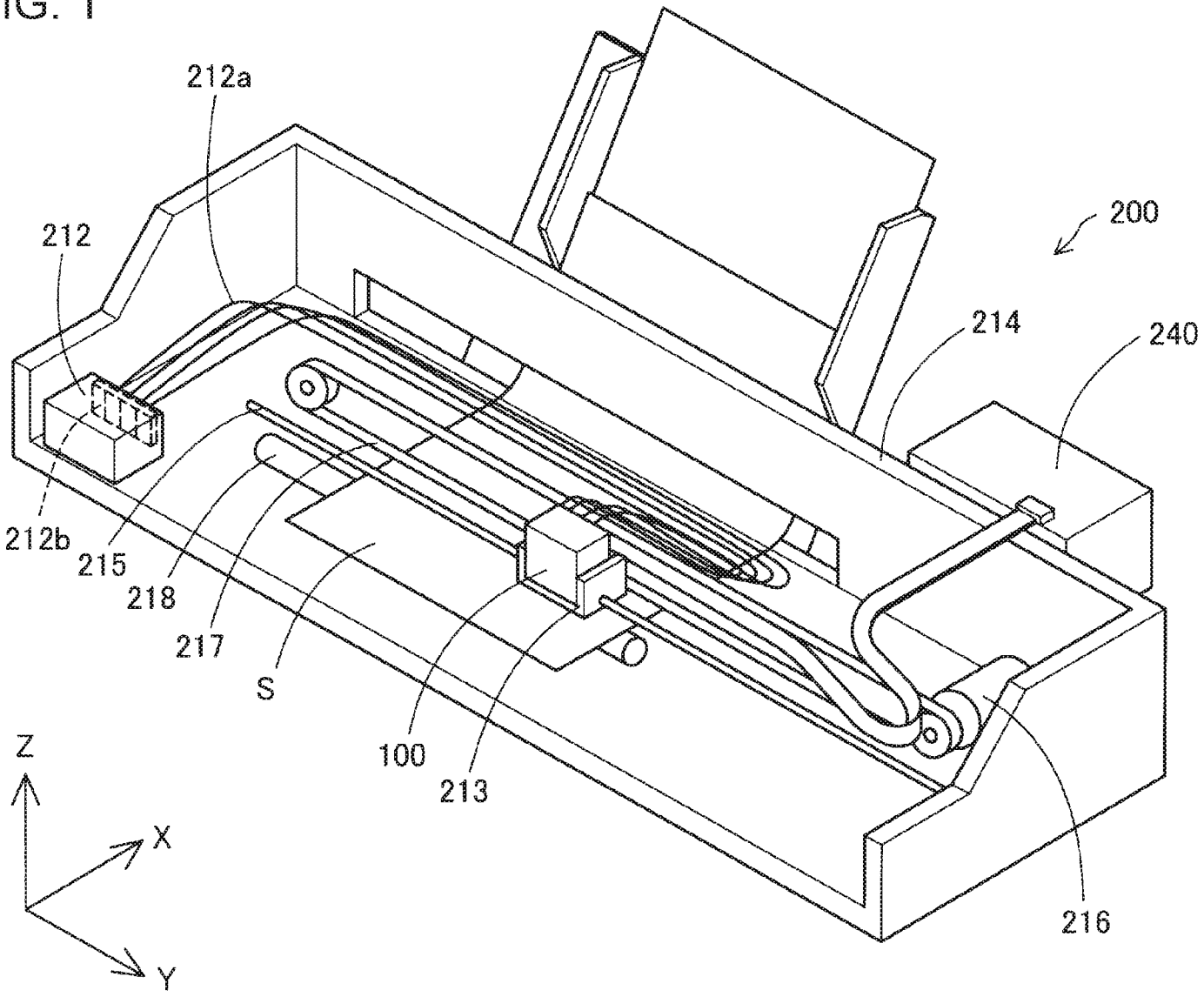
FIG. 1 is a schematic view illustrating a liquid discharge apparatus that includes a liquid discharge head according to an embodiment of the present disclosure.

FIG. 1 is a schematic view illustrating a liquid discharge apparatus 200 that includes a liquid discharge head 100 according to an embodiment of the present disclosure. In a first embodiment, the liquid discharge apparatus 200 is an ink jet recording apparatus. The liquid discharge apparatus 200 includes the liquid discharge head 100, a liquid supply mechanism 212, a carriage 213, an apparatus body 214, a carriage shaft 215, a drive motor 216, a timing belt 217, a transport roller 218, and a controller 240.

The liquid discharge head 100 has nozzles for discharging ink. The ink according to the embodiment is a dye ink that has a pH greater than 9.0, for example, 10. The liquid discharge head 100 is mounted on the carriage 213. The controller 240 performs overall operational control of the liquid discharge apparatus 200 such as an operation for discharging an ink from the liquid discharge head 100. The drive motor 216 transmits a drive force to the carriage 213 by using a plurality of gears (not illustrated) and the timing belt 217. The drive force causes the carriage 213 with the liquid discharge head 100 mounted thereon to be reciprocated in axial directions of the carriage shaft 215 that is attached to the apparatus body 214.

The apparatus body 214 serves as a housing. The apparatus body 214 accommodates the transport roller 218 that serves as a transport section. The transport roller 218 transports a recording sheet S that is a recording medium such as paper. The transport section for transporting the recording sheet S is not limited to the transport roller 218 and may be a belt or a drum. In this embodiment, "X direction" denotes directions in the transport direction of the recording sheet S, with "−X direction" denoting the transport direction and "+X direction" denoting a direction opposite to the transport direction; "Y direction" denotes the moving directions of the carriage 213; and "Z direction" denotes directions orthogonal to the X direction and the Y direction, with "−Z direction" denoting a vertical direction in which an ink is discharged from the liquid discharge head 100. In addition, "X direction" denotes a direction in which nozzle arrays consisting of a plurality of nozzles, which will be described below, are formed.". In FIG. 1 and drawings that will be referred to later, the directions in which arrows point are indicated by "+", and directions opposite to the directions in which the arrows point are indicated by "−".

The liquid supply mechanism 212 includes a liquid storage mechanism such as a liquid tank that stores an ink and a pressure mechanism 212*b* such as a pump that pumps an ink. The liquid supply mechanism 212 is fixed to the apparatus body 214. The pressure mechanism 212*b* supplies a pressurized ink to the liquid discharge head 100 via a supply tube 212*a* such as a flexible tube. Note that the liquid supply mechanism 212 is not limited to the one fixed to the apparatus body 214. For example, the liquid supply mechanism 212 such as an ink cartridge may be held on the liquid discharge head 100 and the liquid supply mechanism may be moved together with the liquid discharge head 100 by the carriage 213. The pressure mechanism 212*b* is driven, for example, in pressure cleaning processing of the liquid discharge head 100 to supply a pressurized ink to the liquid discharge head 100.

Figure 2:
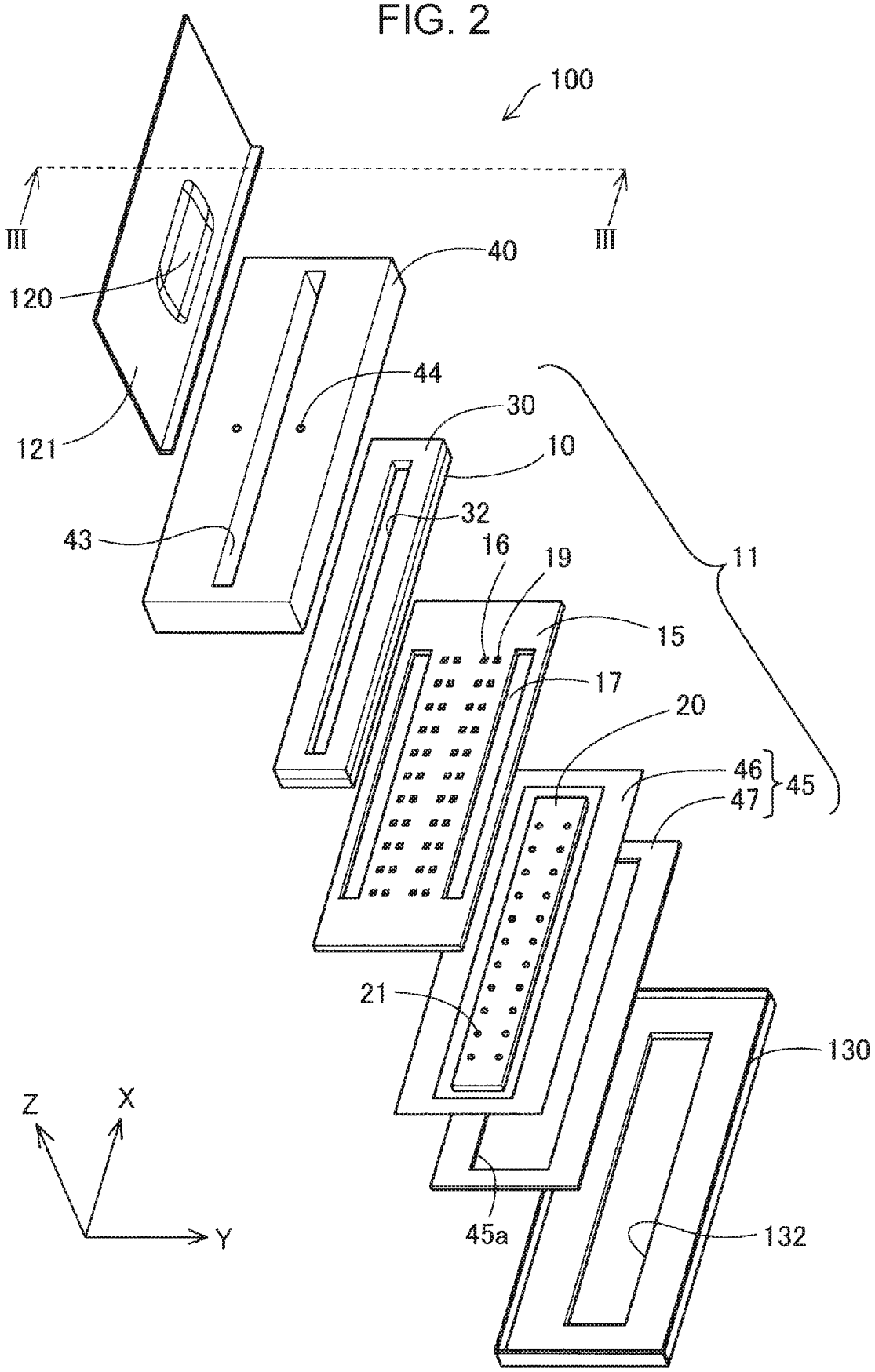
FIG. 2 is an exploded perspective view illustrating a liquid discharge head.
Figure 3:
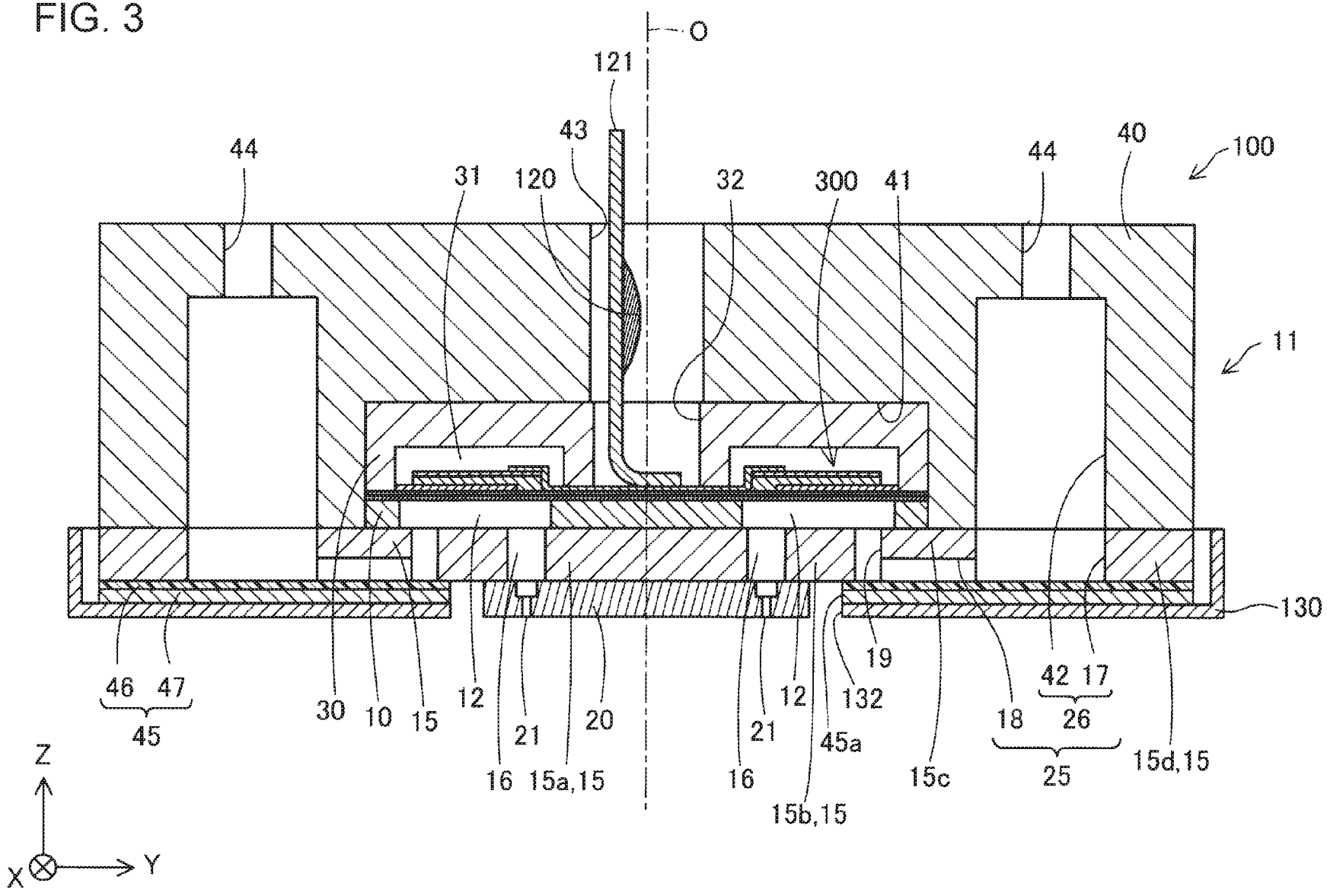
FIG. 3 is a cross-sectional view taken along line III-III in FIG. 2.
Figure 4:
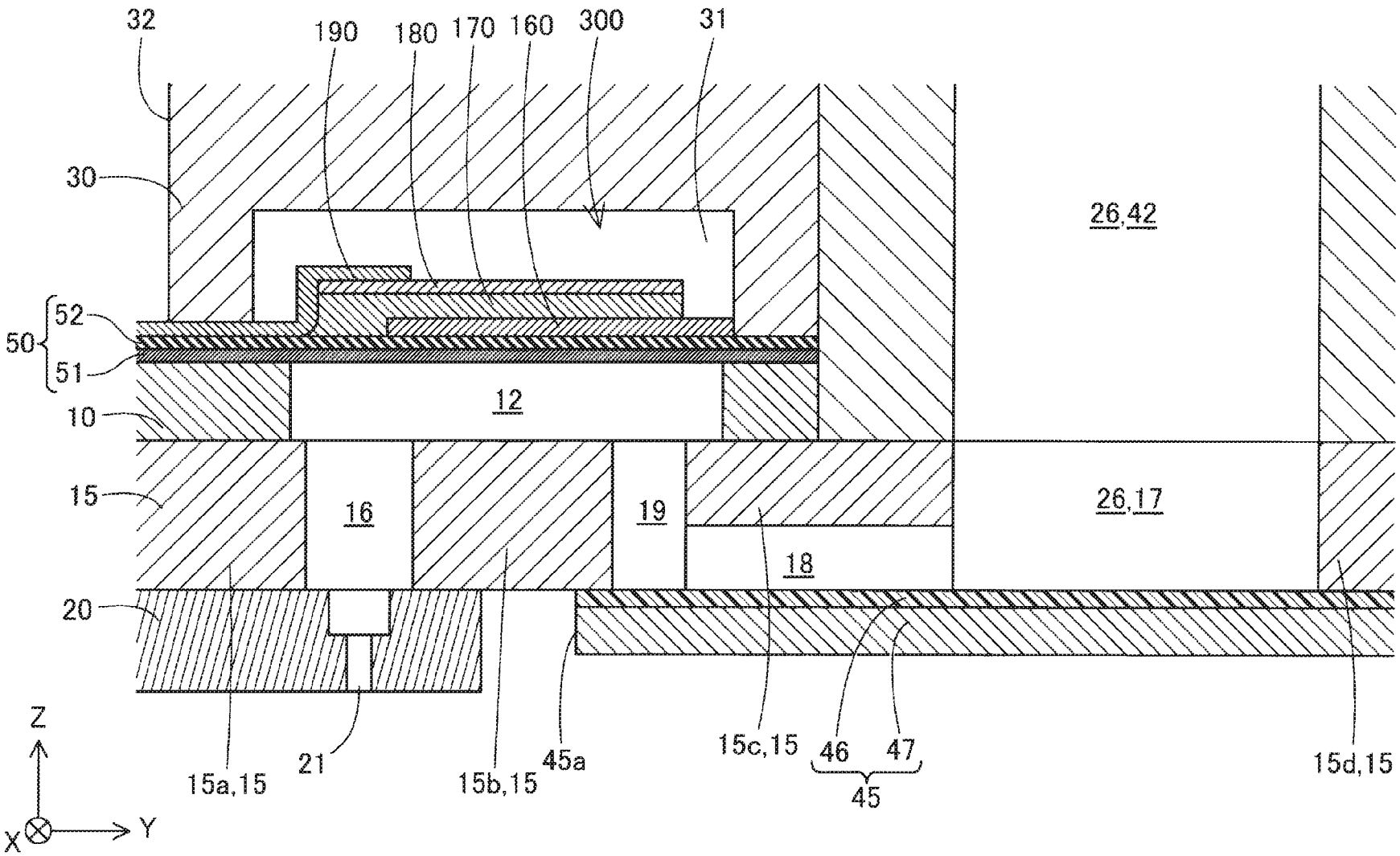
FIG. 4 is a partial enlarged view of FIG. 3.

With reference to FIG. 2, FIG. 3, and FIG. 4, the liquid discharge head 100 will be described. FIG. 2 is an exploded perspective view illustrating the liquid discharge head 100. FIG. 3 is a cross-sectional view taken along line III-III in FIG. 2. FIG. 4 is a partial enlarged view of FIG. 3. The liquid discharge head 100 has planar symmetry with respect to a center plane O illustrated in FIG. 3, and accordingly, in FIG. 4, a structure on the +Y-direction side will be described. FIG. 2 and subsequent drawings illustrate the X direction, the Y direction, and the Z direction in a state in which the liquid discharge head 100 is mounted in the liquid discharge apparatus 200.

As illustrated in FIG. 2, the liquid discharge head 100 includes a head body 11, a case member 40, and a cover member 130. The case member 40 is fixed to one side of the head body 11, and the cover member 130 is fixed to the other side of the head body 11.

The head body 11 includes the pressure chamber plate 10, the communication plate 15, the nozzle plate 20, a protective plate 30, and a compliance plate 45.

The pressure chamber plate 10 is made of a metal such as stainless steel (SUS) or nickel (Ni), a ceramic material such as zirconium dioxide ($ZrO_2$) or aluminum oxide ($AL_2O_3$), a glass ceramic material, or an oxide such as magnesium oxide (MgO) or lanthanum aluminate ($LaAlO_3$). In this embodiment, the pressure chamber plate 10 is made of a silicon single crystal substrate. The pressure chamber plate 10 has pressure chambers 12 formed by anisotropic etching from one side such that the pressure chambers 12 are partitioned side by side by a plurality of partition walls in the X direction.

The pressure chambers 12 communicate with nozzles 21 in the nozzle plate 20 via nozzle communication flow channels 16, which will be described below. The nozzles 21 are openings for discharging an ink onto a recording sheet S. The pressure chamber 12 produces the pressure for discharging an ink supplied to the pressure chamber 12 from the nozzle 21 and applies the pressure to the ink. The pressure chamber 12 is in communication with the supply communication flow channel 19 and the nozzle communication flow channel 16, and the ink from the supply communication flow channel 19 is supplied to the pressure chamber 12.

As illustrated in FIG. 2, on one side of the pressure chamber plate 10, the communication plate 15 and the nozzle plate 20 are stacked sequentially. The communication plate 15 is disposed on one side of the pressure chamber plate 10 and between the pressure chamber plate 10 and the nozzle plate 20. The communication plate 15 has the nozzle communication flow channels 16. Via the nozzle communication flow channels 16, the pressure chambers 12 communicate with the nozzles 21 to guide an ink to the nozzles 21. The communication plate 15 has an area larger than that of the pressure chamber plate 10 when viewed in the Z direction in plan view, and the nozzle plate 20 has an area smaller than that of the pressure chamber plate 10. The communication plate 15 is disposed between the nozzle plate 20 and the pressure chamber plate 10 such that the nozzles 21 in the nozzle plate 20 and the pressure chambers 12 in the pressure chamber plate 10 are apart. With this structure, the ink in the pressure chambers 12 is less affected by thickening due to evaporation of moisture in the ink around the nozzle 21. The communication plate 15 defines a second common liquid chamber 18, which will be described below, that extends in the Y direction in the communication plate 15. The cross-sectional area of the second common liquid chamber 18 can be increased by the height of the communication plate 15 in the Z direction to reduce the flow channel resistance. Furthermore, the nozzle plate 20 covers only the openings of the nozzle communication flow channels 16, and thus the area of the nozzle plate 20 is relatively small. This structure enables the pressure chamber plate 10 to have an area relatively smaller than that of the communication plate 15, reducing costs.

As illustrated in FIG. 3, the communication plate 15 has a first common liquid chamber 17 that is a part of a common liquid chamber 25 and the second common liquid chamber 18. The first common liquid chamber 17 extends through the communication plate 15 in the Z direction, which is a thickness direction. The second common liquid chamber 18 is a recessed portion that is open on the nozzle plate 20 side of the communication plate 15 without extending through the communication plate 15 in the thickness direction. The shape of the opening of the common liquid chamber 25 on the nozzle plate 20 side has a long-side direction and a short-side direction in a plane extending in the X direction and the Y direction. The common liquid chamber 25 having a long-side direction and a short-side direction means that the aspect ratio of the opening of the common liquid chamber 25 on the nozzle plate 20 side is an aspect ratio other than 1:1. The shape of the opening of the common liquid chamber 25 is not particularly limited and may be various shapes, for example, a rectangular shape, a trapezoidal shape, a parallelogram shape, a polygonal shape, or an elliptical shape.

As illustrated in FIG. 3, the pressure chambers 12 are arranged side by side in the X direction, and the common liquid chamber 25 that communicates with each pressure chamber 12 is provided such that, across the pressure chambers 12 arranged side by side in the X direction, the X direction is the long-side direction, that is, the direction of the longer dimension, and the Y direction is the short-side direction, that is, the direction of the shorter dimension. Similarly, the shape of the opening of the common liquid chamber 25 on the nozzle plate 20 side has an X direction that is a long-side direction and a Y direction that is a short-side direction. The first common liquid chamber 17 and a third common liquid chamber 42 extend in the Z direction, defining a first chamber 26 through which an ink flows. The common liquid chamber 25 that includes the first chamber 26 communicates with the nozzles 21 via the supply communication flow channels 19, the pressure chambers 12, and the nozzle communication flow channels 16.

The supply communication flow channel 19 is disposed at one end portion of the pressure chamber 12 in the Y direction. The supply communication flow channel 19 is independently provided for each pressure chamber 12. The supply communication flow channel 19 communicates with the pressure chamber 12 and the second common liquid chamber 18. That is, the pressure chamber 12 communicates with the second common liquid chamber 18 via the supply communication flow channel 19. In other words, the liquid discharge head 100 has, as the flow channels that enable the nozzles 21 and the second common liquid chamber 18 to communicate with each other, the nozzle communication flow channels 16, the pressure chambers 12, and the supply communication flow channels 19. The communication plate 15 may be made of a silicon single crystal substrate. The structure of the communication plate 15 will be described in detail below.

As illustrated in FIG. 2, the nozzle plate 20 has the nozzles 21. Each nozzle 21 communicates with the pressure chamber 12 via the nozzle communication flow channel 16. The nozzles 21 are arranged in arrays of nozzles in the X direction. In this embodiment, two nozzle arrays are formed in the Y direction.

The nozzle plate 20 is made of, for example, a metal such as stainless steel, an organic material such as a polyimide resin, or a silicon single crystal substrate. A silicon single crystal substrate used for the nozzle plate 20 enables the nozzle plate 20 to have a linear expansion coefficient similar to that of the communication plate 15 and suppresses cracking or peeling caused by warpage or heat due to heating or cooling.

As illustrated in FIG. 4, a diaphragm 50 is disposed on one side of the pressure chamber plate 10 opposite to the side where the communication plate 15 is stacked. The diaphragm 50 includes an elastic film 51 and an insulating film 52. The elastic film 51 is made of silicon oxide and is provided on the pressure chamber plate 10 side. The insulating film 52 is made of zirconium oxide and is provided on the elastic film 51. The liquid flow channels such as the pressure chambers 12 are formed by anisotropic etching from one side of the pressure chamber plate 10, and the other side of the liquid flow channels such as the pressure chambers 12 are defined by the elastic film 51 as a wall surface.

On the insulating film 52 of the diaphragm 50, a piezoelectric actuator 300 is provided. The piezoelectric actuator 300 includes a first electrode 160, a piezoelectric layer 170, and a second electrode 180 that are stacked. One of the electrodes of the piezoelectric actuator 300 serves as a common electrode, and the other electrode and the piezoelectric layer 170 are formed by patterning for each pressure chamber 12. The vibrations produced by the piezoelectric actuator 300 are transmitted to the diaphragm 50, causing a change in pressure of the ink in the pressure chamber 12. The diaphragm 50 serves as a pressure generating section for changing the pressure of the ink in the pressure chamber 12 of each nozzle 21. The pressure change is transmitted to the nozzle 21 via the nozzle communication flow channel 16 to discharge the ink from the nozzle 21. The first electrode 160 is used as a common electrode of the piezoelectric actuator 300 and the second electrode 180 is used as an individual electrode of the piezoelectric actuator 300. The arrangement of the common electrode and the individual electrode may be changed depending on the arrangement of the drive circuit or wiring. In the above-described example, the first electrode 160 extends over a plurality of pressure chambers 12, and the first electrode 160 functions as a part of the diaphragm; however, the structure is not limited to this example. For example, without the elastic film 51 and the insulating film 52, only the first electrode 160 may function as the diaphragm, or the piezoelectric actuator 300 may also substantially function as the diaphragm. When the first electrode 160 is disposed on the pressure chamber plate 10, it is preferable that the first electrode 160 be protected by an insulating protective film or the like to prevent an electrical connection between the first electrode 160 and the ink. In this embodiment, the first electrode 160 is provided over the pressure chamber plate 10 via the diaphragm 50; however, the first electrode 160 may be provided directly on the plate without the diaphragm 50. That is, the first electrode 160 may function as the diaphragm.

As illustrated in FIG. 4, a lead electrode 190 is coupled to each second electrode 180. The lead electrode 190 extends on the diaphragm 50. The lead electrode 190 is made of, for example, gold (Au).

On a piezoelectric actuator 300 side of the pressure chamber plate 10, the protective plate 30 is provided. The protective plate 30 has an area the same as that of the pressure chamber plate 10 in plan view in the Z direction. The protective plate 30 is joined to the pressure chamber plate 10, for example, by using an adhesive. The protective plate 30 has an accommodating space 31 that is a space for protecting the piezoelectric actuator 300.

As illustrated in FIG. 3, the case member 40 is fixed to the head body 11 so as to define the common liquid chambers 25, which communicate with the pressure chambers 12, together with the head body 11. The case member 40 has an area the same as that of the communication plate 15 in plan view in the Z direction. The case member 40 is joined to the protective plate 30 and also to the communication plate 15. More specifically, the case member 40 has a concave portion 41 of a depth sufficient to accommodate the pressure chamber plate 10 and the protective plate 30. An opening surface of the concave portion 41 on the nozzle plate 20 side is sealed by the communication plate 15 with the pressure chamber plate 10 and other components being accommodated in the concave portion 41. This structure defines the third common liquid chamber 42 with the case member 40 and the head body 11 on the outer peripheral portion of the pressure chamber plate 10. The common liquid chamber 25 is defined by the first common liquid chamber 17 and the second common liquid chamber 18 in the communication plate 15, and the third common liquid chamber 42 defined by the case member 40 and the head body 11.

The common liquid chambers 25 are disposed on both outer sides of the two pressure chambers 12 in the Y direction. The two common liquid chambers 25 are provided independently in the liquid discharge head 100 so as not to communicate with each other. More specifically, each common liquid chamber 25 is provided for a respective array of the pressure chambers 12 in the X direction.

As illustrated in FIG. 2 and FIG. 3, the case member 40 has ink inlets 44 that communicate with the common liquid chambers 25 to supply an ink to the common liquid chamber 25. The ink inlet 44 communicates with the first chamber 26 of the common liquid chamber 25. An ink pressurized by the pressure mechanism **212*b* is supplied to the ink inlet 44, and the ink inlet 44 enables the ink to flow into the first chamber 26. The ink inlet 44 has, for example, a circular cross section. The case member 40 has a connection port 43 that communicates with a through hole 32 in the protection plate 30, and a wiring board 121 is inserted through the connection port 43. The wiring board 121 that is inserted through the connection port 43 is coupled to the lead electrode 190. On the wiring board 121, a drive circuit 120 is provided. The case member 40** may be made of, for example, a material such as a resin or a metal.

As illustrated in FIG. 2, FIG. 3, and FIG. 4, the compliance plate 45 is provided on a side of the communication plate 15 on which the nozzle plate 20 is provided. More specifically, the compliance plate 45 is disposed on the side of the communication plate 15 on which the first common liquid chambers 17 and the second common liquid chambers 18 are open. As illustrated in FIG. 2, the compliance plate 45 has an area the same as that of the communication plate 15 in plan view in the Z direction and has a first opening 45*a* for exposing the nozzle plate 20. The compliance plate 45 seals the openings of the first common liquid chambers 17 and the second common liquid chambers 18 on the −Z-direction side with the nozzle plate 20 being exposed from the first opening 45*a*. In other words, the compliance plate 45 serves as a part of a wall surface of the common liquid chambers 25.

The compliance plate 45 includes a flexible film 46 and a support section 47. The flexible film 46 is disposed on the communication plate 15 side and is made of a flexible material. The support section 47 is a plate that is disposed opposite the communication plate 15 with the flexible film 46 therebetween. The flexible film 46 and the support section 47 are bonded together, for example, by applying an adhesive over the entire surface of one side of the flexible film 46 and then bringing the support section 47 into contact with the side of the flexible film 46 on which the adhesive has been applied.

The flexible film 46 is a flexible thin film. The flexible film 46 is, for example, a thin film made of polyphenylene sulfide (PPS) or aromatic polyamide and has a thickness of 20 μm or less. The flexible film 46 is a part of the common liquid chamber 25 and functions as a planar vibration absorber. The flexible film 46 serves, for example, as a wall on the −Z-direction side of the first chamber 26 and the second common liquid chamber 18, and the wall is a part of the first chamber 26 and the second common liquid chamber 18. The flexible film 46 absorbs pressure variations in the common liquid chamber 25.

The support section 47 is a plate-like member that supports the flexible film 46 from the side opposite to the side on which the first common liquid chamber 17 is provided. The support section 47 is made of a material harder than the flexible film 46, for example, a metal such as stainless steel.

As illustrated in FIG. 2 and FIG. 3, the cover member 130 and the flexible film 46 are disposed on opposite sides of the support section 47. In other words, the cover member 130 is disposed on the −Z-direction side of the head body 11. The cover member 130 and the nozzle plate 20 are disposed side by side on the Z-direction side, and the cover member 130 protects the −Z-direction side of the liquid discharge head 100. The cover member 130 has a second opening 132 for exposing the nozzle 21. The second opening 132 has a size large enough to expose the nozzle plate 20, that is, a size is at least the same as the first opening 45*a* of the compliance plate 45. End portions of the cover member 130 are bent in the +Z direction to cover the side surfaces of the head body 11.

The cover member 130 is joined to the side of the compliance plate 45 opposite to the side on which the communication plate 15 is disposed to seal the side opposite to the side on which the common liquid chamber 25 are provided. The cover member 130 protects the −Z-direction side of the liquid discharge head 100.

The nozzle communication flow channel 16, the pressure chamber 12, the second common liquid chamber 18, and the first common liquid chamber 17 correspond to the subordinate concept of "flow channel" in the summary.

A2 Structure of Communication Plate

Figure 5:
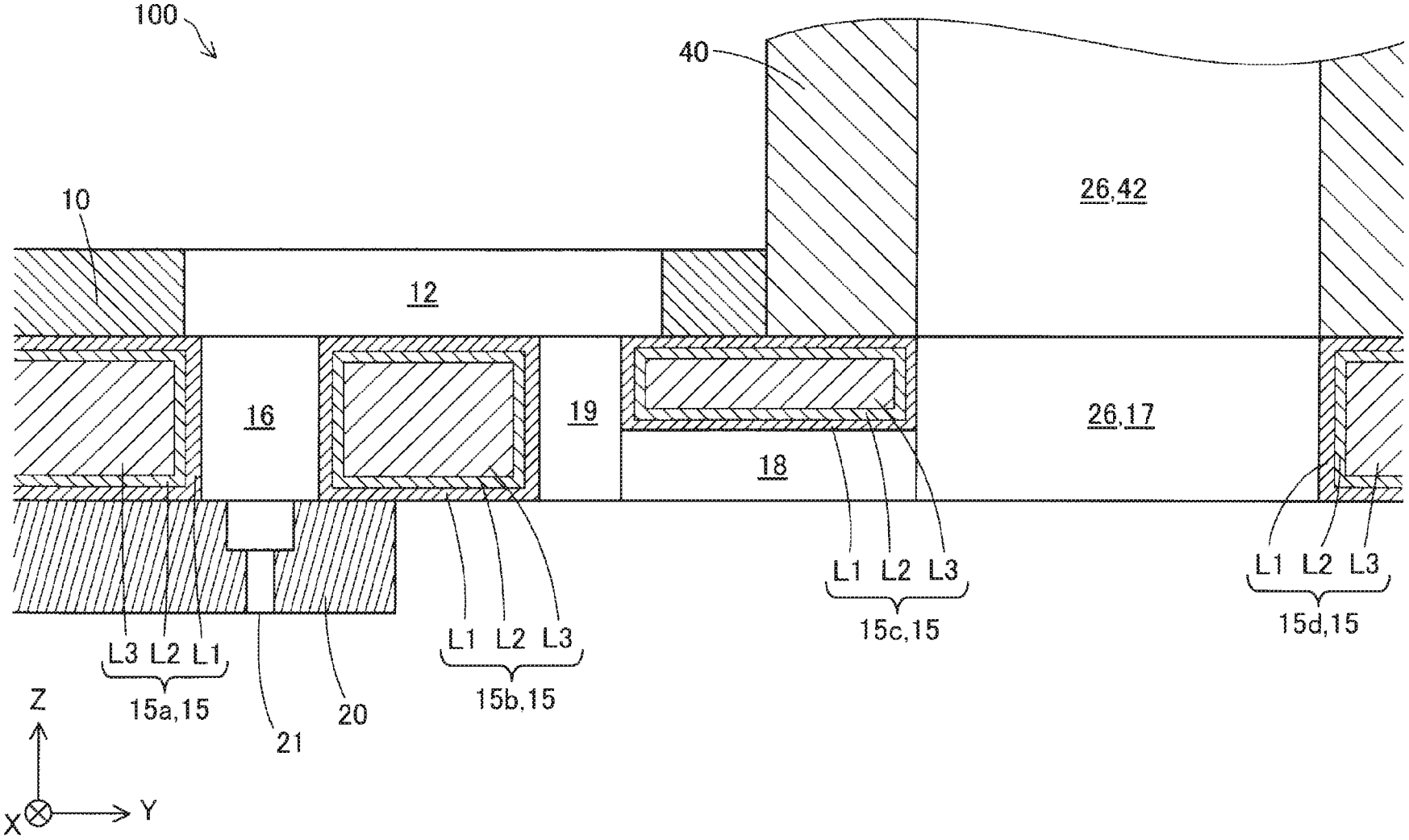
FIG. 5 schematically illustrates a detailed structure of a communication plate.

FIG. 5 schematically illustrates a detailed structure of the communication plate 15. In FIG. 5, the communication plate 15 has a first portion 15*a*, a second portion 15*b*, a third portion 15*c*, and a fourth portion 15*d* for convenience of description. As illustrated in FIG. 5, the communication plate 15 has a first layer L1, a second layer L2, and a third layer L3 that are stacked.

The first layer L1 defines wall surfaces of the flow channels and the communication plate 15. More specifically, in the first portion 15*a*, the first layer L1 defines a −Y-direction side wall surface of the nozzle communication flow channel 16 and Z-direction side wall surfaces of the communication plate 15. In the second portion 15*b*, the first layer L1 defines a +Y-direction side wall surface of the nozzle communication flow channel 16, a −Y-direction side wall surface of the supply communication flow channel 19, a −Z-direction side wall surface of the pressure chamber 12, and a −Z-direction side wall surface of the communication plate 15. In the third portion 15*c*, the first layer L1 defines a +Y-direction side wall surface of the supply communication flow channel 19, a +Z-direction side wall surface of the second common liquid chamber 18, a −Y-direction side wall surface of the first common liquid chamber 17, and a +Z-direction side wall surface of the communication plate 15. In the fourth portion 15*d*, the first layer L1 defines a +Y-direction side wall surface of the first common liquid chamber 17 and Z-direction side wall surfaces of the communication plate 15.

The second layer L2 is stacked on the first layer L1 when viewed from the wall surfaces of the respective flow channels 16, 12, 18, and 17. In other words, the second layer L2 is stacked on the side of the first layer L1 opposite to the wall surfaces of the respective flow channels 16, 12, 18, and 17. The third layer L3 is stacked on the second layer L2 when viewed from the wall surfaces of the respective flow channels 16, 12, 18, and 17. In other words, the third layer L3 is stacked on the side of the second layer L2 opposite to the first layer L1. The layers in the communication plate 15 are thus stacked in the order of the first layer L1, the second layer L2, and the third layer L3 from the outside.

In this embodiment, the first layer L1 is made of, for example, an oxide of tantalum (Ta) such as tantalum oxide ($TaO_3$) or tantalum pentoxide ($Ta_2O_5$). The second layer L2 is made of, for example, an oxide of silicon (Si) such as silicon dioxide ($SiO_2$) or silicon monoxide (SiO). The third layer L3 is made of, for example, an unoxidized silicon (Si) such as single crystal silicon (Si).

It is preferable that the thermal expansion coefficient of the first layer L1 be within the range of $4.6\times10^{-6}$/K to $5.4\times10^{-6}$/K and more preferably $5.01\times10^{-6}$/K. It is preferable that the thermal expansion coefficient of the second layer L2 be within the range of $1.2\times10^{-6}$/K to $2.0\times10^{-6}$/K and more preferably $1.62\times10^{-6}$/K. It is preferable that the thermal expansion coefficient of the third layer L3 be within the range of $2.3\times10^{-6}$/K to $2.9\times10^{-6}$/K and more preferably $2.60\times10^{-6}$/K.

In this embodiment, the thermal expansion coefficient of the second layer L2 is smaller than the thermal expansion coefficient of the first layer L1 and is smaller than the thermal expansion coefficient of the third layer L3. The thermal expansion coefficient of the third layer L3 is smaller than the thermal expansion coefficient of the first layer L1.

As a result of research, the inventors of the disclosure found the following three things:

1. Reduced defects in the first layer L1, which is the surface layer of the communication plate 15, result in reduced damage to the communication plate 15 when the communication plate 15 is subjected to chemical attack due to the ink flowing through the flow channels 16, 12, 18, and 17.

2. Reduced internal stress in the communication plate 15 results in reduced defects in the first layer L1 of the communication plate 15.

3. Increased strength in the first layer L1 results in reduced defects in the first layer L1 of the communication plate 15.

Figure 6:
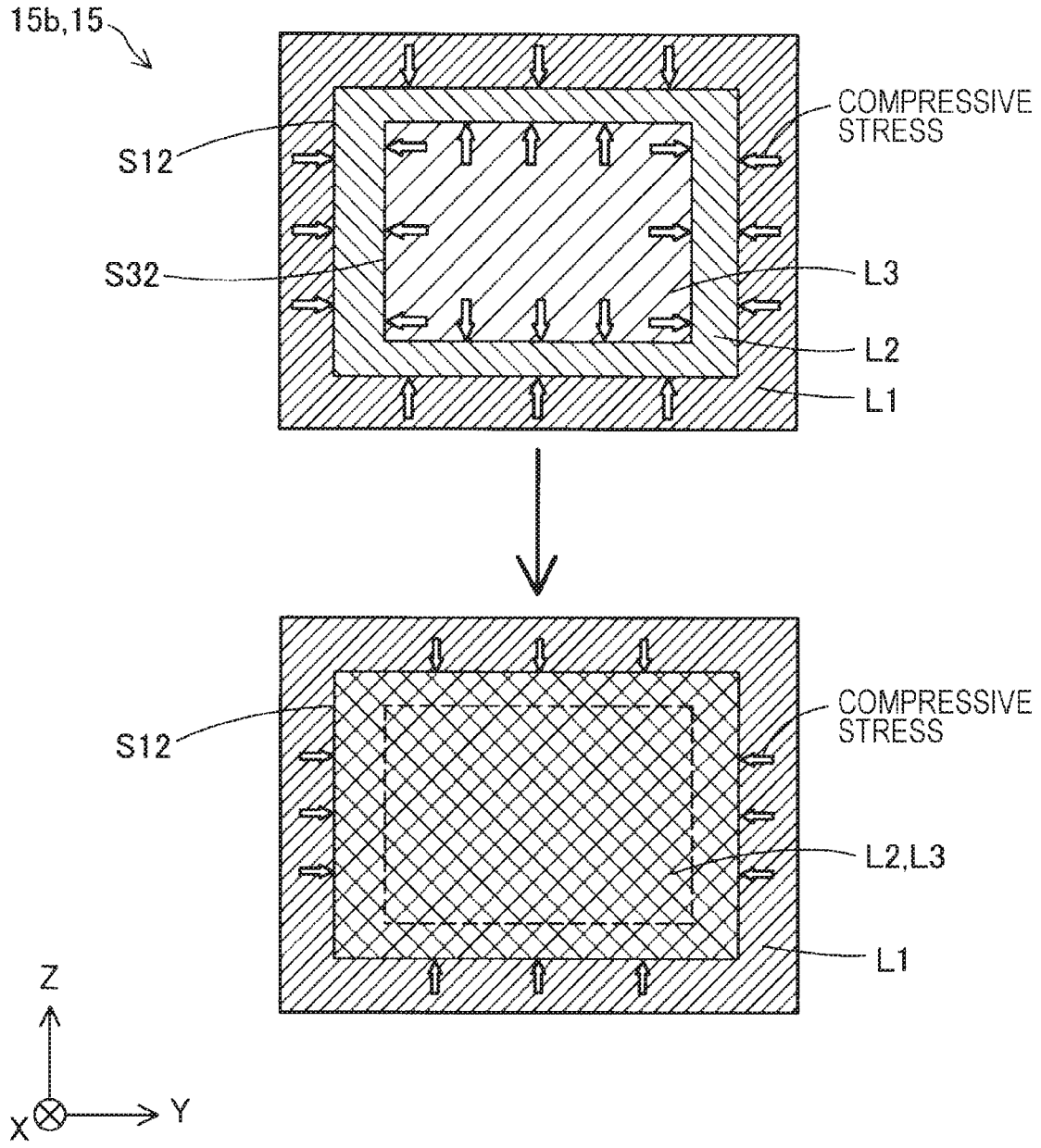
FIG. 6 schematically illustrates internal stress in a communication plate.

FIG. 6 schematically illustrates internal stress in the communication plate 15. FIG. 6 is an enlarged view illustrating the second portion 15*b* of the communication plate 15. As described above, the thermal expansion coefficient of the second layer L2 is smaller than the thermal expansion coefficient of the first layer L1 and is smaller than the thermal expansion coefficient of the third layer L3, and thus membrane stress is produced between the second layer L2 and the first layer L1 and between the second layer L2 and the third layer L3. Since the first layer L1 is made of an oxide of tantalum and the second layer L2 is made of an oxide of silicon, as illustrated by the outlined arrows in the upper part of FIG. 6, the first layer L1 exerts compressive stress on a contact surface S12 of the second layer L2, which is in contact with the first layer L1. The third layer L3 is made of silicon, and as illustrated by the outlined arrows in the upper part of FIG. 6, the third layer L3 exerts compressive stress on a contact surface S32 of the second layer L2, which is in contact with the third layer L3.

In general, membrane stress σ can be expressed by the following equation (1):

$$\sigma = E \times (\alpha_s - \alpha_f) \times (T_g - T_a) \quad (1)$$

where E is Young's modulus (Pa) of the film, $\alpha_s$ is the coefficient of thermal expansion of the substrate (1/K), $\alpha_f$ is the coefficient of thermal expansion of the film (1/K), $T_g$ is the film forming temperature (K), and $T_a$ is the room temperature (K), and $T_g > T_a$.

According to the equation (1), at the contact surface S12 of the second layer L2, which is in contact with the first layer L1, when the second layer L2 is regarded as the substrate and the first layer L1 is the film, $\alpha_s - \alpha_f$ gives a negative number. At the film forming temperature and the room temperature in this embodiment, σ=approx. −120 MPa. Consequently, the first layer L1 exerts compressive stress on the second layer L2.

At the contact surface S32 of the second layer L2, which is in contact with the third layer L3, when the third layer L3 is regarded as the substrate and the second layer L2 is the film, $\alpha_s - \alpha_f$ gives a negative number. At the film forming temperature and the room temperature in this embodiment, σ=approx. 142 MPa. Consequently, the second layer L2 exerts tensile stress on the third layer L3. In other words, the third layer L3 exerts compressive stress on the second layer L2.

Accordingly, throughout the communication plate 15 as a whole, the resultant of the film stress on the contact surface S12 and the film stress on the contact surface S32, that is, the internal stress of the communication plate 15 is −120+142=22 MPa. In contrast, in a construction in which the second layer L2 is not provided in the communication plate, between the first layer L1 and the third layer L3, when the third layer L3 is regarded as the substrate and the first layer L1 is the film, $\alpha_s - \alpha_f$ gives a negative number. At a film forming temperature and a room temperature approximately the same as those in the embodiment, σ=approx. −85.3 MPa. Compared with a structure without the second layer L2, this embodiment can thus achieve an internal stress of the communication plate 15 closer to zero. Accordingly, as illustrated in a lower part of FIG. 6, the internal stress in the communication plate 15 can be relieved. As a result, according to the equation (2), the communication plate 15 according to the embodiment has fewer defects in the first layer L1.

As mentioned above, the second layer L2 and the third layer L3 are made of oxides and thus provide tighter physical contact between the second layer L2 and the third layer L3 than in a structure that has the stacked first layer L1 and the third layer L3 without the second layer L2. In general, silicon (third layer L3) has a high affinity for silicon oxide (second layer L2). Throughout the communication plate 15 as a whole, with the increased strength of the joints between the layers L1, L2, and L3, the strength of the first layer L1 is increased. As a result, according to the equation (3), the communication plate 15 according to the embodiment has fewer defects in the first layer L1.

According to the equation (1), fewer defects in the first layer L1, which is the surface layer of the communication plate 15, result in reduced damage to the communication plate 15 when the communication plate 15 is subjected to chemical attack due to the ink flowing through the flow channels 16, 12, 18, and 17.

The communication plate 15 that has the above-described structure can be formed, for example, by stacking the second layer L2 on the third layer L3 and then stacking the first layer L1 through the following procedure. In this embodiment, the second layer L2 is formed by thermal oxidation treatment of a silicon substrate that is the third layer L3. More specifically, first, a silicon substrate such as a silicon wafer is put in a firing furnace. The atmosphere in the firing furnace is adjusted in advance to an oxygen atmosphere. In the firing furnace, for example, the silicon substrate is heat-treated at 200° C. Oxygen in the firing furnace bonds with silicon in the silicon substrate, and a film of the second layer L2 is formed on the surface of the silicon substrate (third layer L3). The thickness of the second layer L2 is within the range of 700 μm to 900 μm and is, for example, 800 μm.

The first layer L1 is formed on the second layer L2 by atomic layer deposition (ALD). More specifically, the silicon substrate with the second layer L2 formed thereon is removed from the firing furnace and placed in an ALD film forming apparatus. Then, tantalum is applied to the surface of the second layer L2 to form a film, and thereby the film of the first layer L1 is formed on the surface of the second layer L2. The thickness of the first layer L1 is within the range of 5 μm to 40 μm and is, for example, 25 μm. The first layer L1 may be formed by a thin film forming method by plasma chemical vapor deposition (CVD) instead of atomic layer deposition. With the procedure, the communication plate 15 that has the stacked first layer L1, the second layer L2, and the third layer L3 can be formed. In this embodiment, the thickness of the first layer L1 is less than the thickness of the second layer L2.

The communication plate 15 in the liquid discharge head 100 according to the embodiment described above includes the first layer L1, which defines the wall surfaces of the nozzle communication flow channels 16, the pressure chambers 12, the second common liquid chamber 18, and the first common liquid chamber 17, which are ink flow channels, the second layer L2, which is stacked on the first layer L1 when viewed from the wall surfaces, and the third layer L3, which is stacked on the second layer L2 when viewed from the wall surfaces, and the thermal expansion coefficient of the second layer L2 is smaller than the thermal expansion coefficient of the first layer L1 and is smaller than the thermal expansion coefficient of the third layer L3. With this structure, the stress produced between the first layer L1 and the third layer L3 can be absorbed and reduced by the stress produced between the first layer L1 and the second layer L2 and the stress produced between the second layer L2 and the third layer L3. Consequently, throughout the communication plate 15 as a whole, the resultant of the tensile stress and the compressive stress between the layers L1, L2, and L3 becomes a value close to zero. Accordingly, lower internal stress is produced in the communication plate 15 than in a structure without the second layer L2 in the communication plate 15, and thus damage to the communication plate can be reduced when the communication plate is subjected to chemical attack due to the ink flowing through the flow channels 16, 12, 18, and 17.

At the contact surface S12 of the second layer L2, which is in contact with the first layer L1, compressive stress from the first layer L1 is produced, and at the contact surface S32 of the second layer L2, which is in contact with the third layer L3, compressive stress from the third layer L3 is produced, and tensile stress is produced from the second layer L2 to the third layer L3 and tensile stress is produced from the second layer L2 to the first layer L1. With this structure, throughout the communication plate 15 as a whole, the resultant of the tensile stress and the compressive stress between the layers L1, L2, and L3 becomes a value close to zero.

The first layer L1 is made of an oxide of tantalum, the second layer L2 is made of an oxide of silicon, and the third layer L3 is made of silicon. With this structure, while the resistance to the ink that flows through the nozzle communication flow channels 16, the pressure chambers 12, the second common liquid chamber 18, and the first common liquid chamber 17, which are ink flow channels, is increased, the strength of the communication plate 15 can be increased. More specifically, the first layer L1 made of an oxide of tantalum can increase the resistance to the ink flowing through the flow channels 16, 12, 18, and 17. The second layer L2 made of an oxide of silicon and the third layer L3 made of silicon can increase the affinity between the second layer L2 and the third layer L3. The first layer L1 and the second layer L2 made of oxides can increase the physical contact between the first layer L1 and the second layer L2.

The thermal expansion coefficient of the third layer L3 is smaller than the thermal expansion coefficient of the first layer L1, and thus stress can be produced between the first layer and the third layer.

The pH of the ink is greater than 9.0, and the etching rate for the first layer L1 that forms the wall surfaces of the nozzle communication flow channels 16, the pressure chambers 12, the second common liquid chamber 18, and the first common liquid chamber 17, which are ink flow channels, can be increased. Consequently, the occurrence of chemical attack on the first layer L1 due to the ink flowing through the flow channels 16, 12, 18, and 17 can be suppressed.

B. Second Embodiment

Figure 7:
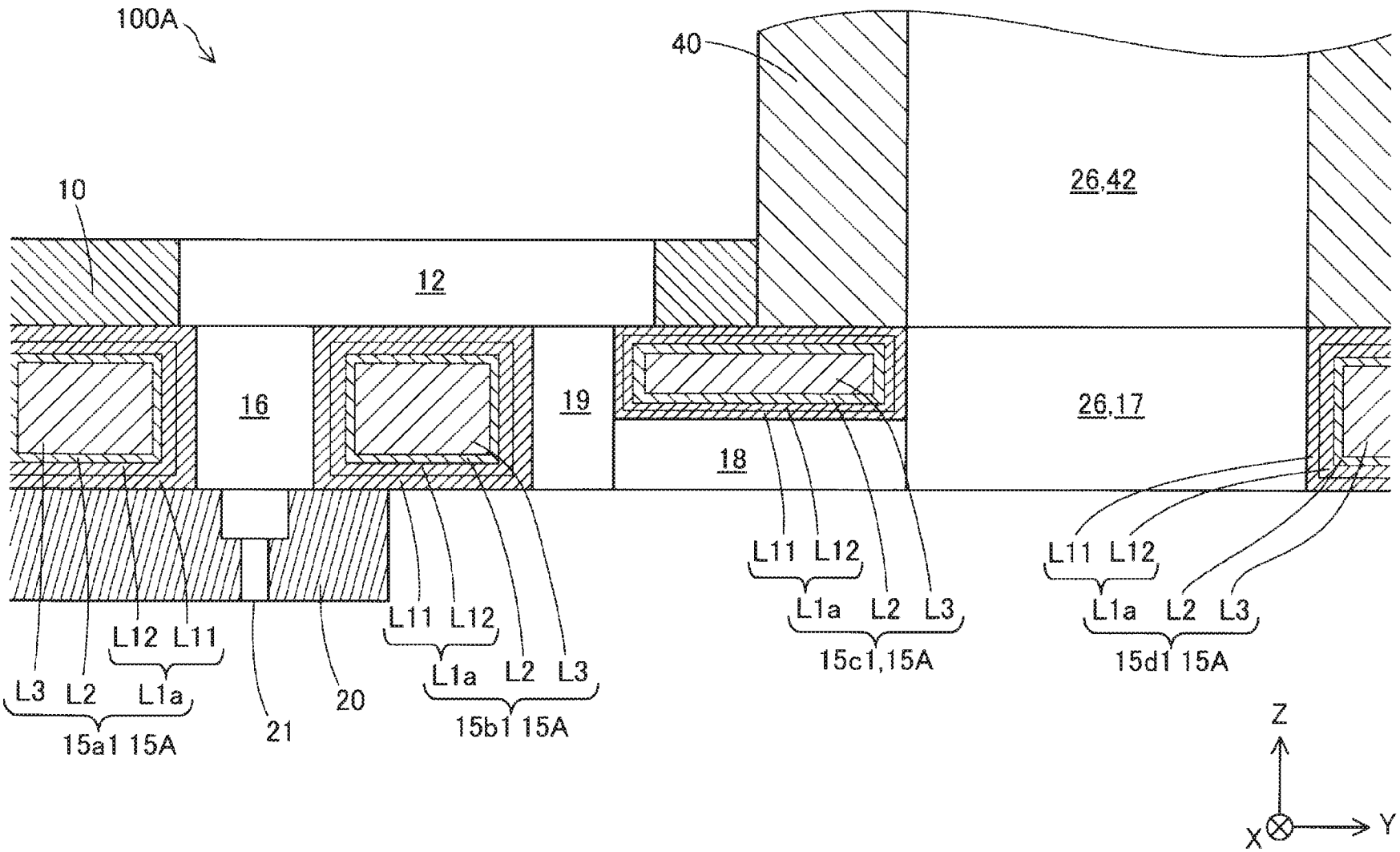
FIG. 7 schematically illustrates a detailed structure of a communication plate in a liquid discharge head according to a second embodiment.

In the following description, to components similar to those in the first embodiment, the same reference numerals are applied and their descriptions are omitted. FIG. 7 schematically illustrates a detailed structure of a communication plate 15A in a liquid discharge head 100A according to a second embodiment. FIG. 7 illustrates a structure that corresponds to the structure of the liquid discharge head 100 in FIG. 5. The same applies to the drawings that will be referred to in the following description. The liquid discharge head 100A according to the second embodiment is different from the liquid discharge head 100 according to the first embodiment in that the communication plate 15A is provided instead of the communication plate 15. The communication plate 15A according to the second embodiment is different from the communication plate 15 according to the first embodiment in that a first layer L1*a* is provided instead of the first layer L1.

The first layer L1*a* has two layers of the same composition that are stacked. More specifically, as illustrated in FIG. 7, the first layer Lia has an outer layer L11 and an inner layer L12. Each of the outer layer L11 and the inner layer L12 is a thin film that has the same composition as the first layer L1 according to the first embodiment. The outer layer L11 serves as wall surfaces of the nozzle communication flow channels 16, the pressure chambers 12, the second common liquid chamber 18, and the first common liquid chamber 17. The inner layer L12 is stacked on the outer layer L11 when viewed from the wall surfaces. The second layer L2 is stacked on the inner layer L12 when viewed from the wall surfaces. The number of the layers in the first layer L1*a* is not limited to two, and three or more layers may be stacked. In general, stacking a plurality of layers enables defects to be arranged in different positions in the individual layers. Consequently, as the number of the stacked layers in the first layer L1*a* is increased, the ink flowing into the communication plate 15A through the defects can be prevented from reaching the third layer L3.

The communication plate 15A according to the second embodiment can be formed through the following procedure. Through a procedure similar to that for forming the communication plate 15 according to the first embodiment, the third layer L3, the second layer L2, and the inner layer L12 can be formed. Then, tantalum is applied to the surface of the inner layer L12 to form a film, and thereby the film of the outer layer L11 is formed on the surface of the inner layer L12. By the procedure, the communication plate 15A that has the stack of the two-layered first layer L1*a*, the second layer L2, and the third layer L3 can be formed.

The liquid discharge head 100A according to the second embodiment described above includes the first layer L1*a* that has the stacked outer layer L11 and inner layer L12 of the same composition, and thus the strength of the first layer L1*a* can be increased.

C. Other Embodiments

1. In the first embodiment, the communication plate 15 has the stacked first layer L1, second layer L2, and third layer L3 in all of the portions 15*a*, 15*b*, 15*c*, and 15*d*, which define the wall surfaces of the nozzle communication flow channels 16, the pressure chambers 12, the second common liquid chambers 18, and the first common liquid chambers 17; however, the present disclosure is not limited to the structure. For example, the first portion 15*a* and the second portion 15*b* that define the wall surfaces of the nozzle communication flow channels 16 may have the first layer L1, the second layer L2, and the third layer L3 that are stacked, and the third portion 15*c* and the fourth portion 15*d* may have only the first layer L1.

Alternatively, for example, the second portion 15*b* and the third portion 15*c* that define the wall surfaces of the supply communication flow channels 19 may have the first layer L1, the second layer L2, and the third layer L3 that are stacked, and the first portion 15*a* and the fourth portion 15*d* may have only the first layer L1. That is, in general, in the communication plate 15, in the flow channels for guiding an ink to the nozzles 21, in at least one of the nozzle communication flow channel 16, the pressure chamber 12, the supply communication flow channel 19, and the second common liquid chamber 18, the first layer L1 may define the wall surface of the flow channel, and the second layer L2 and the third layer L3 may be stacked on the first layer in this order. This similarly applies to the second embodiment.

Figure 8:
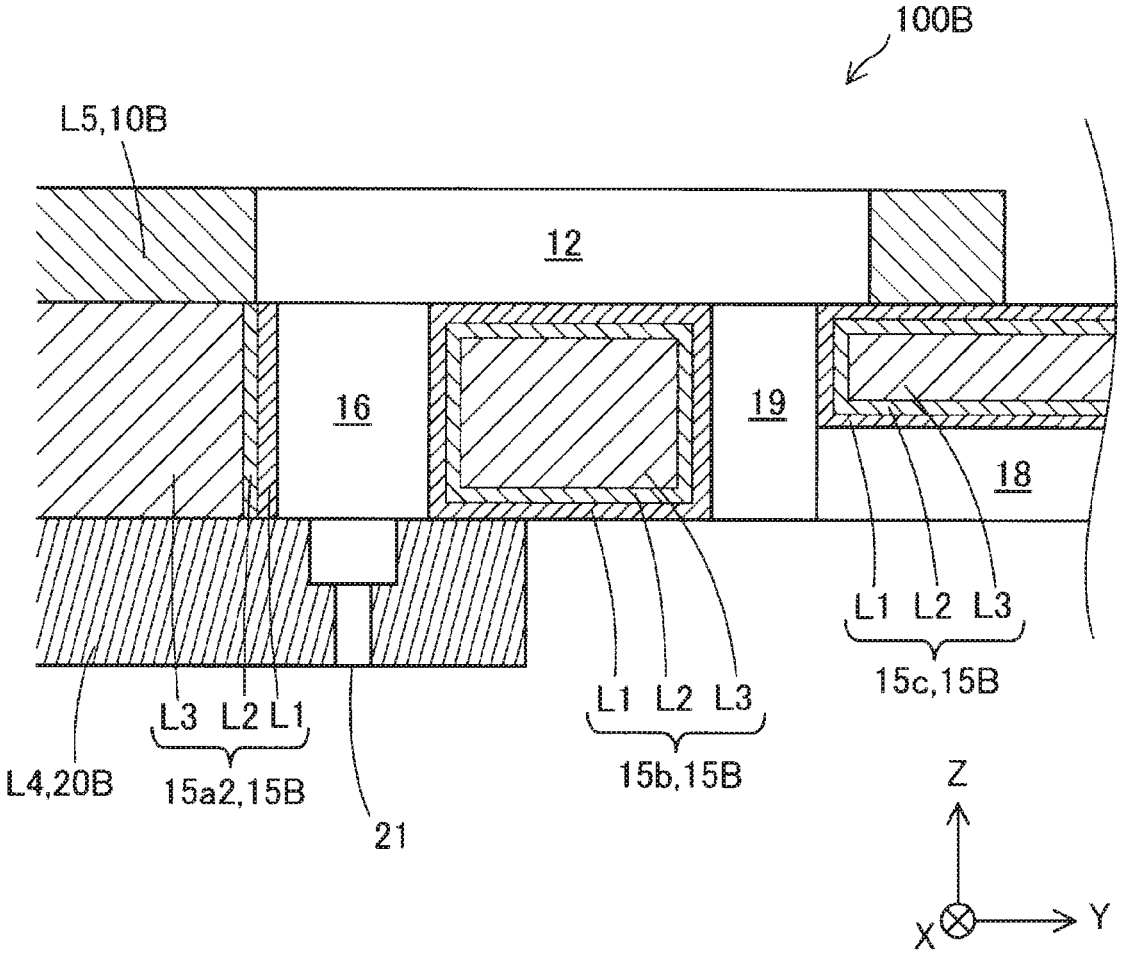
FIG. 8 schematically illustrates a structure of another liquid discharge head according to the second embodiment.

2. FIG. 8 schematically illustrates a structure of a liquid discharge head 100B according to the second embodiment. FIG. 8 is an enlarged view of a part near the nozzle communication flow channel 16 and the supply communication flow channel 19. The liquid discharge head 100B according to the second embodiment is different from the liquid discharge head 100 according to the first embodiment in that a communication plate 15B is provided instead of the communication plate 15, a nozzle plate 20B is provided instead of the nozzle plate 20, and a pressure chamber plate 10B is provided instead of the pressure chamber plate 10.

The communication plate 15B is different from the communication plate 15 according to the first embodiment in that a first portion 15*a*2 is provided instead of the first portion 15*a*. As illustrated in FIG. 8, in the first portion 15*a*, a portion that faces the nozzle communication flow channel 16 has the first layer L1, the second layer L2, and the third layer L3 that are stacked, and a portion that faces the pressure chamber plate 10B and the nozzle plate 20B has only the third layer L3. That is, in the width direction (Y direction) of the communication plate 15B, the first layer L1, the second layer L2, and the third layer L3 are stacked, and in the thickness direction (Z direction) of the communication plate 15, only the third layer L3 is provided without the first layer L1 and the second layer L2. The communication plate 15B of the structure can be formed by forming the communication plate 15 according to the first embodiment and then scraping the surface of the communication plate 15 on the thickness direction side.

The nozzle plate 20B has a fourth layer L4 of the same composition as the third layer L3 of the communication plate 15B. The nozzle plate 20B and the first portion 15*a*2 in the communication plate 15B are joined together by stacking the fourth layer L4 and the third layer L3. With this structure, the physical contact between the nozzle plate 20B and the first portion 15*a*2 in the communication plate 15B can be increased.

The pressure chamber plate 10B has a fifth layer L5 of the same composition as the third layer L3 of the communication plate 15B. The pressure chamber plate 10B and the first portion 15*a*2 in the communication plate 15B are joined together by stacking the third layer L3 and the fifth layer L5. With this structure, the physical contact between the pressure chamber plate 10B and the first portion 15*a*2 in the communication plate 15B can be increased.

Figure 9:
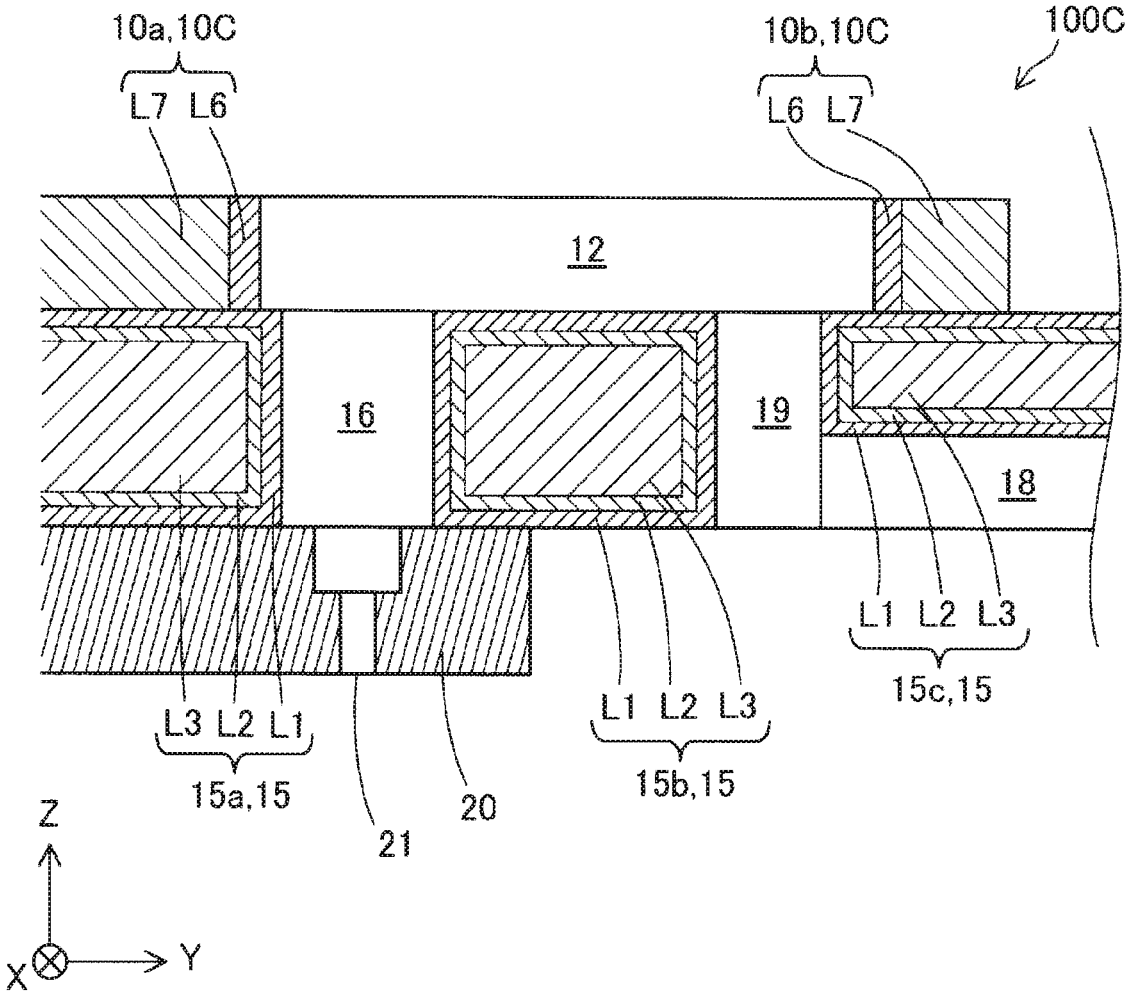
FIG. 9 schematically illustrates a structure of a liquid discharge head according to a third embodiment.

3. FIG. 9 schematically illustrates a structure of a liquid discharge head 100C according to a third embodiment. FIG. 9 is an enlarged view of a part near the nozzle communication flow channel 16 and the supply communication flow channel 19, similarly to FIG. 8. The liquid discharge head 100C according to the third embodiment is different from the liquid discharge head 100 according to the first embodiment in that a pressure chamber plate 10C is provided instead of the pressure chamber plate 10.

The pressure chamber plate 10C has a sixth layer L6 and a seventh layer L7 that are stacked in the Y direction. More specifically, in a first portion 10*a* and a second portion 10*b* in the pressure chamber plate 10C, the sixth layer L6 defines wall surfaces of the pressure chamber 12, and the seventh layer L7 is stacked to face the sixth layer L6. The sixth layer L6 has the same composition as the first layer L1 of the communication plate 15. The seventh layer L7 has the same composition as the third layer L3 of the communication plate 15.

As illustrated in FIG. 9, the first portion 10*a* in the pressure chamber plate 10C and the first portion 15*a* in the communication plate 15 are joined together by stacking the first layer L1 and the sixth layer L6 at the wall surfaces of the nozzle communication flow channel 16 and the pressure chamber 12. The second portion 10*b* in the pressure chamber plate 10C and the third portion 15*c* in the communication plate 15 are joined together by stacking the first layer L1 and the sixth layer L6 at the wall surfaces of the pressure chamber 12 and the supply communication flow channel 19. As described above, the first layer L1 and the sixth layer L6 have the same composition. In general, when members of the same composition are joined, their bonding strength is increased and their adhesion is increased. Consequently, at the portions where the nozzle communication flow channel 16, the pressure chamber 12, and the supply communication flow channel 19 are formed, the physical contact between the pressure chamber plate 10C and the communication plate 15 can be increased.

4. In the above-described embodiments, the second layer L2 is made of an oxide of silicon; however, instead of the oxide of silicon, diamond-like carbon may be used. The thermal expansion coefficient of diamond-like carbon is smaller than the thermal expansion coefficient of silicon that is the material of the first layer L1. The second layer L2 made of diamond-like carbon can absorb and reduce the stress produced between the first layer L1 and the third layer L3 by using the stress produced between the first layer L1 and the second layer L2 and the stress produced between the second layer L2 and the third layer L3. Consequently, throughout the communication plate 15 as a whole, the resultant of the tensile stress and the compressive stress between the respective layers becomes a value close to zero. Furthermore, diamond-like carbon has a relatively high resistance to ink, and thus an ink flowing into the communication plate 15 through defects in the first layer L1 can be prevented from reaching the third layer L3 from the second layer L2.

5. In the above-described embodiments, the ink is a dye ink, but may be a pigment ink. The pH of the ink may be 9.0 or less. The liquid to be discharged from the nozzles 21 may be liquids other than the ink. The example liquids include:

1. Color materials for the manufacture of color filters for image display apparatuses such as liquid crystal displays
2. Electrode materials for the manufacture of electrodes for organic electro luminescence (EL) displays, field emission displays (FEDs), or the like
3. Liquids that contain bioorganic compounds and are to be used for the manufacture of biochips
4. Samples supplied to precision pipettes
5. Lubricating oils
6. Resin liquids
7. Transparent resin liquids such as ultraviolet curing resin liquids for forming micro hemispherical lenses (optical lenses) or the like to be used for optical communication elements or other elements
8. Acid or alkaline etching solutions for etching substrates or the like
9. Any other minute droplets.

The "droplets" mean a state of the liquid that is discharged from the liquid discharge apparatus 200, and include granular droplets, tear droplets, or stringy droplets. The "liquids" may be any material that can be used in the liquid discharge apparatus 200. For example, the "liquids" may be any material that is in a liquid phase, including liquids having high or low viscosity, and liquid materials such as sol, gel water, other inorganic solvents, organic solvents, solutions, liquid resins, and liquid metals (metal melts). Further, the "liquids" are not limited to liquids that are in one state of materials but include liquids in which particles of a functional material composed of a solid material such as a pigment or metal particles are dissolved, dispersed, or mixed in a solvent. Typical examples of the liquids include inks, liquid crystals, and the like. The inks may be inks that contain various kinds of liquid compositions, such as general water-based inks, oil-based inks, gel inks, hot melt inks, and the like. These embodiments can also achieve effects similar to those in the above-described embodiments.

The present disclosure is not limited to the above-described embodiments, and various modifications may be made without departing from the scope of the present disclosure. For example, technical features in the embodiments corresponding to the technical features in the embodiment described in the summary may be replaced or combined to solve some or all of the above-described problems or to achieve some or all of the above-described effects. Unless the technical features are described as essential in this specification, the technical features may be omitted as appropriate.

D. Other Embodiments

1. According to an embodiment of the present disclosure, a liquid discharge head is provided. The liquid discharge head includes a nozzle plate having nozzles configured to discharge a liquid, a pressure chamber plate having pressure chambers in communication with the nozzles, the pressure chambers being configured to apply pressure to the liquid to discharge the liquid from the nozzles, and a communication plate disposed between the nozzle plate and the pressure chamber plate, the communication plate having a communication flow channel for guiding the liquid to the nozzles. The communication plate has a first layer that defines a wall surface of the communication flow channel, a second layer stacked on a side of the first layer opposite to the wall surface, and a third layer stacked on a side of the second layer opposite to the first layer, and the thermal expansion coefficient of the second layer is smaller than the thermal expansion coefficient of the first layer and is smaller than the thermal expansion coefficient of the third layer.

In the liquid discharge head according to the embodiment, the communication plate has a first layer that defines a wall surface of the communication flow channel, a second layer stacked on a side of the first layer opposite to the wall surface, and a third layer stacked on a side of the second layer opposite to the first layer, and the thermal expansion coefficient of the second layer is smaller than the thermal expansion coefficient of the first layer and is smaller than the thermal expansion coefficient of the third layer. With this structure, the stress produced between the first layer and the third layer can be absorbed and reduced by the stress produced between the first layer and the second layer and the stress produced between the second layer and the third layer. Throughout the communication plate as a whole, the resultant of the tensile stress and the compressive stress between the layers becomes a value close to zero. Consequently, lower internal stress is produced in the communication plate than in a structure without the second layer in the communication plate, and thus damage to the communication plate can be reduced when the communication plate is subjected to chemical attack due to the liquid flowing through the flow channel.

2. In the liquid discharge head, at a contact surface of the second layer that is in contact with the first layer, compressive stress from the first layer may be produced, and at a contact surface of the second layer that is in contact with the third layer, compressive stress from the third layer may be produced. In the liquid discharge head, at a contact surface of the second layer that is in contact with the first layer, compressive stress from the first layer is produced, and at a contact surface of the second layer that is in contact with the third layer, compressive stress from the third layer is produced, and tensile stress is produced from the second layer to the third layer and tensile stress is produced from the second layer to the first layer. Consequently, throughout the communication plate as a whole, the resultant of the tensile stress and the compressive stress between the layers becomes a value close to zero.

3. In the liquid discharge head, the first layer may be made of an oxide of tantalum, the second layer may be made of an oxide of silicon, and the third layer may be made of silicon. In the liquid discharge head, the first layer is made of an oxide of tantalum, the second layer is made of an oxide of silicon, and the third layer is made of silicon, and thus, while the resistance to the liquid that flows through the communication flow channel is increased, the strength of the communication plate can be increased. More specifically, the first layer made of an oxide of tantalum can increase the resistance to the liquid flowing through the flow channel. The second layer made of an oxide of silicon and the third layer made of silicon can increase the affinity between the second layer and the third layer. The first layer and the second layer made of oxides can increase the physical contact between the first layer and the second layer.

4. In the liquid discharge head, the first layer may have a plurality of films of the same composition that are stacked. The liquid discharge head includes the first layer that has the stacked films of the same composition, and thus the strength of the first layer can be increased.

5. According to another embodiment, a liquid discharge head is provided. The liquid discharge head includes a nozzle plate having nozzles configured to discharge a liquid, a pressure chamber plate having pressure chambers in communication with the nozzles, the pressure chambers being configured to apply pressure to the liquid to discharge the liquid from the nozzles, and a communication plate disposed between the nozzle plate and the pressure chamber plate, the communication plate having a communication flow channel for guiding the liquid to the nozzles. The communication plate has a first layer that defines a wall surface of the communication flow channel, a second layer stacked on a side of the first layer opposite to the wall surface, and a third layer stacked on a side of the second layer opposite to the first layer, and at a contact surface of the second layer that is in contact with the first layer, compressive stress from the first layer may be produced, and at a contact surface of the second layer that is in contact with the third layer, compressive stress from the third layer may be produced. In the liquid discharge head according to the embodiment, the communication plate has a first layer that defines a wall surface of the communication flow channel, a second layer stacked on a side of the first layer opposite to the wall surface, and a third layer stacked on a side of the second layer opposite to the first layer, and at a contact surface of the second layer that is in contact with the first layer, compressive stress from the first layer is produced, and at a contact surface of the second layer that is in contact with the third layer, compressive stress from the third layer is produced, and thus tensile stress is produced from the second layer to the third layer and tensile stress is produced from the second layer to the first layer. Consequently, throughout the communication plate as a whole, the resultant of the tensile stress and the compressive stress between the layers becomes a value close to zero.

6. According to still another embodiment, a liquid discharge head is provided. The liquid discharge head includes a nozzle plate having nozzles configured to discharge a liquid, a pressure chamber plate having pressure chambers in communication with the nozzles, the pressure chambers being configured to apply pressure to the liquid to discharge the liquid from the nozzles, and a communication plate disposed between the nozzle plate and the pressure chamber plate, the communication plate having a communication flow channel for guiding the liquid to the nozzles. The communication plate has a first layer that defines a wall surface of the communication flow channel, a second layer stacked on a side of the first layer opposite to the wall surface, and a third layer stacked on a side of the second layer opposite to the first layer, and the first layer may be made of an oxide of tantalum, the second layer may be made of an oxide of silicon, and the third layer may be made of silicon. In the liquid discharge head, the communication plate has a first layer that defines a wall surface of the communication flow channel, a second layer stacked on a side of the first layer opposite to the wall surface, and a third layer stacked on a side of the second layer opposite to the first layer, and the first layer is made of an oxide of tantalum, the second layer is made of an oxide of silicon, and the third layer is made of silicon. With this structure, while the resistance to the liquid that flows through the communication flow channel is increased, the strength of the communication plate can be increased. More specifically, the first layer made of an oxide of tantalum can increase the resistance to the liquid flowing through the flow channel. The second layer made of an oxide of silicon and the third layer made of silicon can increase the affinity between the second layer and the third layer. The first layer and the second layer made of oxides can increase the physical contact between the first layer and the second layer.

7. In the liquid discharge head, the nozzle plate may have a fourth layer of the same composition as the third layer, and the communication plate and the nozzle plate may be joined together by stacking the third layer and the fourth layer. In the liquid discharge head, the nozzle plate has a fourth layer of the same composition as the third layer, and the communication plate and the nozzle plate are joined together by stacking the third layer and the fourth layer. Consequently, the physical contact between the communication plate and the nozzle plate can be increased.

8. In the liquid discharge head, the pressure chamber plate may have a fifth layer of the same composition as the third layer, and the communication plate and the pressure chamber plate may be joined together by stacking the third layer and the fifth layer. In the liquid discharge head, the pressure chamber plate has a fifth layer of the same composition as the third layer, and the communication plate and the pressure chamber plate are joined together by stacking the third layer and the fifth layer. Consequently, the physical contact between the communication plate and the nozzle plate can be increased.

9. In the liquid discharge head, the thermal expansion coefficient of the third layer may be smaller than the thermal expansion coefficient of the first layer. In the liquid discharge head, the thermal expansion coefficient of the third layer is smaller than the thermal expansion coefficient of the first layer, and thus stress can be produced between the first layer and the third layer.

10. In the liquid discharge head, the communication plate may have a common liquid chamber that communicates with the pressure chambers, the pressure chamber plate may have a sixth layer that defines a wall surface of the pressure chambers and a seventh layer that is stacked on a side opposite to the sixth layer and has the same composition as the third layer, and the sixth layer may have the same composition as the first layer. In the liquid discharge head, the communication plate has a common liquid chamber that communicates with the pressure chambers, the pressure chamber plate has a sixth layer that defines a wall surface of the pressure chambers and a seventh layer that is stacked on a side opposite to the sixth layer and has the same composition as the third layer, and the sixth layer has the same composition as the first layer. At the portions where the pressure chambers are formed, the physical contact between the pressure chamber plate and the communication plate can be increased.

11. In the liquid discharge, the pH of the liquid may be greater than 9.0. In the liquid discharge head, the pH of the liquid is greater than 9.0, and the etching rate for the first layer that forms the wall surfaces of the communication flow channel can be increased. Consequently, the occurrence of chemical attack on the first layer due to the liquid flowing through the communication flow channel can be suppressed.

12. In the liquid discharge head, the communication flow channel may be a nozzle communication flow channel in communication with the nozzles and the pressure chambers.

13. In the liquid discharge head, the communication plate may have a common liquid chamber that communicates with the nozzles to supply the liquid, and the communication flow channel may be a supply communication flow channel in communication with the pressure chambers and the common liquid chamber.

14. In the liquid discharge head, the thickness of the first layer may be less than the thickness of the second layer.

15. According to still another embodiment of the present disclosure, a liquid discharge apparatus is provided. The liquid discharge apparatus includes the liquid discharge head according to any one of the above embodiments, and a controller configured to control an operation of discharging the liquid from the liquid discharge head.

The present disclosure is not limited to the above-described liquid discharge heads, but may be various apparatuses or methods such as liquid discharge apparatuses having liquid discharge heads or methods for manufacturing liquid discharge heads.

What is claimed is:

1. A liquid discharge head comprising:

a nozzle plate having nozzles configured to discharge a liquid;

a pressure chamber plate having pressure chambers in communication with the nozzles, the pressure chambers being configured to apply pressure to the liquid to discharge the liquid from the nozzles; and a communication plate disposed between the nozzle plate and the pressure chamber plate, the communication plate having a communication flow channel for guiding the liquid to the nozzles, wherein the communication plate has a first layer that defines a wall surface of the communication flow channel, a second layer stacked on a side of the first layer opposite to the wall surface, and a third layer stacked on a side of the second layer opposite to the first layer, and the thermal expansion coefficient of the second layer is smaller than the thermal expansion coefficient of the first layer and is smaller than the thermal expansion coefficient of the third layer.

2. The liquid discharge head according to claim 1, wherein at a contact surface of the second layer that is in contact with the first layer, compressive stress from the first layer is produced, and at a contact surface of the second layer that is in contact with the third layer, compressive stress from the third layer is produced.

3. The liquid discharge head according to claim 1, wherein the first layer is made of an oxide of tantalum, the second layer is made of an oxide of silicon, and the third layer is made of silicon.

4. The liquid discharge head according to claim 1, wherein the first layer comprises a plurality of films of the same composition that are stacked.

5. The liquid discharge head according to claim 1, wherein the nozzle plate has a fourth layer of the same composition as the third layer, and the communication plate and the nozzle plate are joined together by stacking the third layer and the fourth layer.

6. The liquid discharge head according to claim 1, wherein the pressure chamber plate has a fifth layer of the same composition as the third layer, and the communication plate and the pressure chamber plate are joined together by stacking the third layer and the fifth layer.

7. The liquid discharge head according to claim 1, wherein the thermal expansion coefficient of the third layer is smaller than the thermal expansion coefficient of the first layer.

8. The liquid discharge head according to claim 1, wherein the communication plate has a common liquid chamber that communicates with the pressure chambers, the pressure chamber plate has a sixth layer that defines a wall surface of the pressure chambers and a seventh layer that is stacked on a side opposite to the sixth layer and has the same composition as the third layer, and the sixth layer has the same composition as the first layer.

9. The liquid discharge head according to claim 1, wherein the pH of the liquid is greater than 9.0.

10. The liquid discharge head according to claim 1, wherein the communication flow channel is a nozzle communication flow channel in communication with the nozzles and the pressure chambers.

11. The liquid discharge head according to claim 1, wherein the communication plate has a common liquid chamber that communicates with the nozzles to supply the liquid, and the communication flow channel is a supply communication flow channel in communication with the pressure chambers and the common liquid chamber.

12. The liquid discharge head according to claim 1, wherein the thickness of the first layer is less than the thickness of the second layer.

13. A liquid discharge apparatus comprising:

the liquid discharge head according to claim 1, and a controller configured to control an operation of discharging the liquid from the liquid discharge head.

14. A liquid discharge head comprising:

a nozzle plate having nozzles configured to discharge a liquid;

a pressure chamber plate having pressure chambers in communication with the nozzles, the pressure chambers being configured to apply pressure to the liquid to discharge the liquid from the nozzles; and a communication plate disposed between the nozzle plate and the pressure chamber plate, the communication plate having a communication flow channel for guiding the liquid to the nozzles, wherein the communication plate has a first layer that defines a wall surface of the communication flow channel, a second layer stacked on a side of the first layer opposite to the wall surface, and a third layer stacked on a side of the second layer opposite to the first layer, and at a contact surface of the second layer that is in contact with the first layer, compressive stress from the first layer is produced, and at a contact surface of the second layer that is in contact with the third layer, compressive stress from the third layer is produced.

15. A liquid discharge head comprising:

a nozzle plate having nozzles configured to discharge a liquid;

a pressure chamber plate having pressure chambers in communication with the nozzles, the pressure chambers being configured to apply pressure to the liquid to discharge the liquid from the nozzles; and a communication plate disposed between the nozzle plate and the pressure chamber plate, the communication plate having a communication flow channel for guiding the liquid to the nozzles, wherein the communication plate has a first layer that defines a wall surface of the communication flow channel, a second layer stacked on a side of the first layer opposite to the wall surface, and a third layer stacked on a side of the second layer opposite to the first layer, and the first layer is made of an oxide of tantalum, the second layer is made of an oxide of silicon, and the third layer is made of silicon.

* * * * *